US008079828B2

(12) United States Patent
Togawa et al.

(10) Patent No.: US 8,079,828 B2
(45) Date of Patent: Dec. 20, 2011

(54) WATER PUMP

(75) Inventors: Kyosuke Togawa, Nishikamo-gun (JP); Takasuke Shikida, Okazaki (JP); Kazunari Adachi, Kariya (JP); Takashi Sakumoto, Kariya (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 615 days.

(21) Appl. No.: 12/223,028

(22) PCT Filed: Dec. 26, 2007

(86) PCT No.: PCT/JP2007/074953

§ 371 (c)(1),
(2), (4) Date: Jul. 21, 2008

(87) PCT Pub. No.: WO2008/078774

PCT Pub. Date: Jul. 3, 2008

(65) Prior Publication Data

US 2009/0022606 A1 Jan. 22, 2009

(30) Foreign Application Priority Data

Dec. 27, 2006 (JP) ..... 2006-351938

(51) Int. Cl.
*F04B 17/00* (2006.01)

(52) U.S. Cl. ..... 417/319; 417/420

(58) Field of Classification Search ..... 417/364, 417/410.1, 420, 423.4, 319, 223; *F01P 5/12, F01P 7/08, 7/16; F04D 13/02*

See application file for complete search history.

(56) References Cited

U.S. PATENT DOCUMENTS 2,230,717 A * 2/1941 De Lancey ..... 417/223
2,725,185 A * 11/1955 Willcox ..... 416/55
4,065,234 A * 12/1977 Yoshiyuki et al. ..... 417/420
4,780,066 A * 10/1988 Bolleter et al. ..... 417/420
6,007,303 A 12/1999 Schmidt

FOREIGN PATENT DOCUMENTS

| | | |
|---|---|---|
| EP | 1 801 420 A2 | 6/2007 |
| JP | A-11-6433 | 1/1999 |
| JP | A-2000-125541 | 4/2000 |
| JP | A-2000-257428 | 9/2000 |
| JP | A-2000-274241 | 10/2000 |
| JP | A-2001-90537 | 4/2001 |

(Continued)

OTHER PUBLICATIONS

Japanese English translation for Application 2004041823—Publication No. 2005233044.*

(Continued)

*Primary Examiner* — Charles Freay
(74) *Attorney, Agent, or Firm* — Oliff & Berridge, PLC

(57) ABSTRACT

In one embodiment of the present invention, a water pump (10) is configured such that rotation is transmitted in a non-contact condition from a drive-end rotation member (20) whereto rotation is transmitted from an engine to a driven-end rotation member (30) having a pump impeller (31). The drive-end rotation member (20) includes a vacuum chamber (50) and a pair of permanent magnets (26*a*, 26*b*) provided so as to be mutually opposed with different polarities. The driven-end rotation member (30) includes an induction ring (32) having an induction section (32*b*) provided so as to form a prescribed interval between the pair of permanent magnets (26*a*, 26*b*). Furthermore, the pair of permanent magnets (26*a*, 26*b*) is moved in a rotation axis direction with respect to the induction section (32*b*) due to the vacuum introduced into the vacuum chamber (50), and the overlap amount (L1) of the pair of permanent magnets (26*a*, 26*b*) and the induction section (32*b*) in the rotation axis direction is changed.

5 Claims, 4 Drawing Sheets

FOREIGN PATENT DOCUMENTS

| | | | |
|---|---|---|---|
| JP | 2005233044 | A * | 9/2005 |
| JP | A-2007-285268 | | 11/2007 |

OTHER PUBLICATIONS

"Impeller, n.". OED Online. Mar. 2011. Oxford University Press. Jun. 4, 2011 <http://www.oed.com/view/Entry/92207?redirectedFrom=impeller>. (retrieved from http://dictionary.oed.com on Mar. 23, 2010).*

Apr. 8, 2010 Search Report issued in European Patent Application No. 07860182.0.

* cited by examiner

- When no vacuum is introduced

- When vacuum is introduced

WATER PUMP

TECHNICAL FIELD

The present invention relates to variable volume type water pumps used in engines mounted in, for example, vehicles and the like.

BACKGROUND ART

Items such as that disclosed in, for example, patent document 1 have been proposed as variable volume type water pumps conventionally used in engines mounted in vehicles and the like. Patent document 1 discloses a water pump wherein a first rotation member (drive-end rotation member) whereto a water pump pulley is fixed and a second rotation member (driven-end rotation member) whereto a pump impeller is fixed are connected via a multiplate wet clutch having a viscous fluid as a medium. Furthermore, provision inside a cooling water channel of a temperature sensitive member deforming according to a temperature of cooling water in order to disconnect the multiplate wet clutch is disclosed. The water pump specified in this patent document 1 is configured such that, when a water temperature is low, driving of the water pump is substantially stopped in order to reduce friction and prevent deterioration of fuel efficiency, and furthermore, when a water temperature is high, the clutch is set to an engaged condition and rotation of the first rotation member is transmitted to the second rotation member.

In addition, items wherein transmission of rotation from the drive-end rotation member to the driven-end rotation member is carried out in a non-contact condition have also been proposed as variable volume type water pumps. The components of this water pump related to the transmission of rotation from the drive-end rotation member to the driven-end rotation member are shown in FIG. 4.

As shown in FIG. 4, an interval between a drive-end rotation member 101 and a driven-end rotation member 103 is partitioned by a dividing wall 105. In addition, a permanent magnet 102 mounted on the drive-end rotation member 101 and an induction ring 104 mounted on the driven-end rotation member 103 are provided so as to be opposed with a prescribed interval therebetween. The induction ring 104 is configured having an aluminum ring member 104*b* mounted on an outer periphery of a magnetic core 104*a*. When the drive-end rotation member 101 rotates, the magnetic field of the permanent magnet 102 acting on the induction ring 104 changes. As a result of this, an induction current in a direction obstructing that magnetic field change is generated in the ring member 104*b* of the induction ring 104. A torque is generated in the ring member 104*b* of the induction ring 104 pursuant to this induction-current generation. As a result, the driven-end rotation member 103 rotates and the water pump drives.

Furthermore, the torque transmitted to the driven-end rotation member 103 is changed by changing an overlap amount (degree of mutual overlap in the axial direction) L2 of the permanent magnet 102 of the drive-end rotation member 101 and the ring member 104*b* of the induction ring 104 in an axial direction (rotation axis direction). As a result, modification of a pump flow volume of the water pump is possible.

Patent document 1: JP2001-90537

DISCLOSURE OF INVENTION

Problem to be Solved by the Invention

However, a multiplate wet clutch had to be provided across an interval between the first rotation member and the second rotation member in the water pump specified in the above-explained patent document 1. Furthermore, a temperature sensitive member had to be provided in order to disconnect this multiplate wet clutch. In addition, the construction required a seal to be achieved between the first rotation member and the second rotation member. For this reason, a problem existed in the form of increases in water pump size.

Furthermore, in a water pump as shown in FIG. 4 performing transmission of rotation from the drive-end rotation member 101 to the driven-end rotation member 103 in a non-contact condition, the magnetic field from the permanent magnet 102 extends not only to the ring member 104*b* of the induction ring 104, but also extends to the surroundings thereof, and flux leakage occurs. That is to say, lines of magnetic force from the permanent magnet 102 occur so as to spread out further than this permanent magnet 102 to an outer side in an axial direction. As a result, an efficiency of transmission of torque to the driven-end rotation member 103 is impaired. Furthermore, even when the overlap amount L2 is set to "0", an induction current is generated in the induction ring 104 of the driven-end rotation member 103 as a result of that flux leakage, a torque transmitted to the driven-end rotation member 103 is generated, and the water pump drives. In order, therefore, to stop driving of the water pump, simply setting the overlap amount L2 to "0" is not sufficient, and it is necessary to offset the permanent magnet 102 and the ring member 104*b* of the induction ring 104 by a prescribed distance in the axial direction. As a result, the water pump increases in size in the axial direction, and mounting characteristics at locations of installation of the water pump (for example, a front end of an engine) deteriorate.

The present invention takes this type of problem into consideration, and an object thereof is to provide a variable volume type water pump facilitating more compact designs.

Means for Solving Problem

The present invention is configured as follows as a means of solving the aforementioned problems. That is to say, a water pump, configured such that rotation is transmitted in a non-contact condition from a drive-end rotation member whereto rotation is transmitted from an engine to a driven-end rotation member having a pump impeller includes a pair of magnets provided on one of the drive-end rotation member and the driven-end rotation member so as to be mutually opposed with different polarities; an induction body provided on the other of the drive-end rotation member and the driven-end rotation member so as to form a prescribed interval between the pair of magnets; and a moving means moving at least one of the pair of magnets and the induction body with respect to another thereof in a rotation axis direction and changing a degree of mutual overlap (overlap amount) of the pair of magnets and the induction body in the rotation axis direction thereof.

With the above-explained configuration, a magnetic field is generated between the pair of magnets of the drive-end rotation member. Furthermore, when the rotation of the engine is transmitted and the drive-end rotation member rotates, the magnetic field acting on the induction body changes. As a result of this, an induction current in a direction obstructing the magnetic field change is generated in the induction body. A torque is generated in the induction body pursuant to this induction-current generation. As a result, the driven-end rotation member rotates and the water pump drives. Furthermore, if the overlap amount is changed by the moving means, the induction current generated in the induction body changes and the torque transmitted to the driven-end rotation member changes. As a result, a pump flow volume of the water pump changes.

In addition, as the pair of magnets are disposed so as to be mutually opposed with different polarities, lines of magnetic force extending substantially linearly towards one of the pair of magnets to the other thereof are generated. For this reason, almost no leakage of flux to the surroundings of the pair of magnets occurs. As a result of this, when the overlap amount is set larger than "0" and the water pump is driven, torque can be efficiently transmitted to the driven-end rotation member and drive loss due to flux leakage can be reduced. Meanwhile, if the overlap amount is set to "0", as the lines of magnetic force are generated with almost no widening beyond the pair of magnets to an outer side in the axial direction, the torque transmitted to the driven-end rotation member becomes substantially "0", and driving of the water pump can be stopped. Accordingly, it becomes no longer necessary to secure an offset amount in the rotation axis direction for the pair of magnets and the induction body, the water pump does not increase in size in the axial direction, and a compact configuration thereof can be achieved. In addition, deterioration of mounting characteristics at locations of installation of the water pump can be avoided.

In the water pump according to the present invention, it is preferable that the moving means includes a vacuum chamber provided on one of the drive-end rotation member and the driven-end rotation member and a movable member moving in the rotation axis direction in accordance with a vacuum introduced into this vacuum chamber, and that the pair of magnets or the induction body is provided on the movable member. In this configuration, when the movable member moves in the rotation axis direction in accordance with the vacuum introduced into the vacuum chamber, the position in the rotation axis direction of the pair of magnets or the induction body mounted on this movable member changes and the overlap amount changes. Accordingly, the overlap amount can be set in accordance with the vacuum introduced into the vacuum chamber, and pursuant to this, the pump flow volume of the water pump can be continuously changed.

In the water pump according to the present invention, it is preferable that the vacuum chamber includes the movable member and a guide member guiding a motion of this movable member towards the rotation axis direction. Furthermore, it is preferable that, for example, an intake vacuum (suction-pipe vacuum) of the engine is used as the vacuum introduced into the vacuum chamber. By using the engine's intake vacuum in this way, in a situation wherein, for example, cooling water is not circulated so much in order to promote warming of the engine when cold and powerful acceleration is required, control is performed to rotate the pump impeller and overheating thus can be prevented.

Effect of the Invention

In accordance with the present invention, when the degree of mutual overlap of the pair of magnets and the induction body in the rotation axis direction (overlap amount) is set larger than "0" and the water pump is driven, torque can be efficiently transmitted to the driven-end rotation member and drive loss due to flux leakage can be reduced. Meanwhile, if the overlap amount is set to "0", the torque transmitted to the driven-end rotation member becomes substantially "0", and driving of the water pump can be stopped. Accordingly, it becomes no longer necessary to secure an offset amount in the rotation axis direction for the pair of magnets and the induction body, the water pump does not increase in size in the axial direction, and a compact configuration thereof can be achieved. In addition, deterioration of mounting characteristics at locations of installation of the water pump can be avoided.

DESCRIPTION OF REFERENCE NUMERALS

Figure 1:
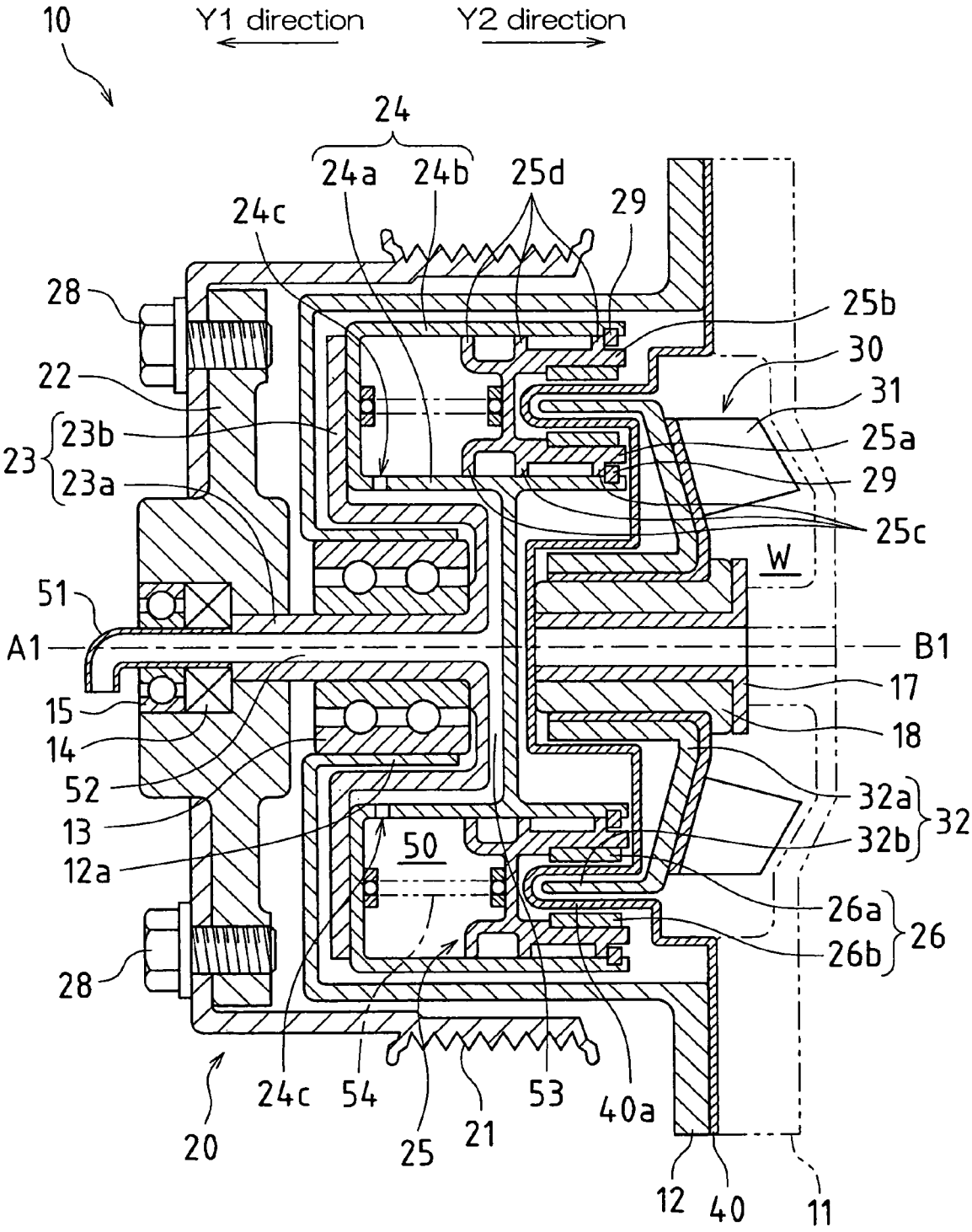
FIG. 1 is a cross-section view showing one embodiment of a variable volume type water pump according to the present invention.

10 Water pump
11 Housing
20 Drive-end rotation member
21 Water pump pulley
24 Bracket guide member
25 Magnet bracket
26 Magnet coupling
26*a*, 26*b* Permanent magnets
30 Driven-end rotation member
31 Pump impeller
32 Induction ring
32*b* Induction section
40 Dividing wall
50 Vacuum chamber
L1 Overlap amount

BEST MODE FOR CARRYING OUT THE INVENTION

The following is a description of a preferred embodiment of the present invention, with reference to accompanying drawings.

Figure 2:
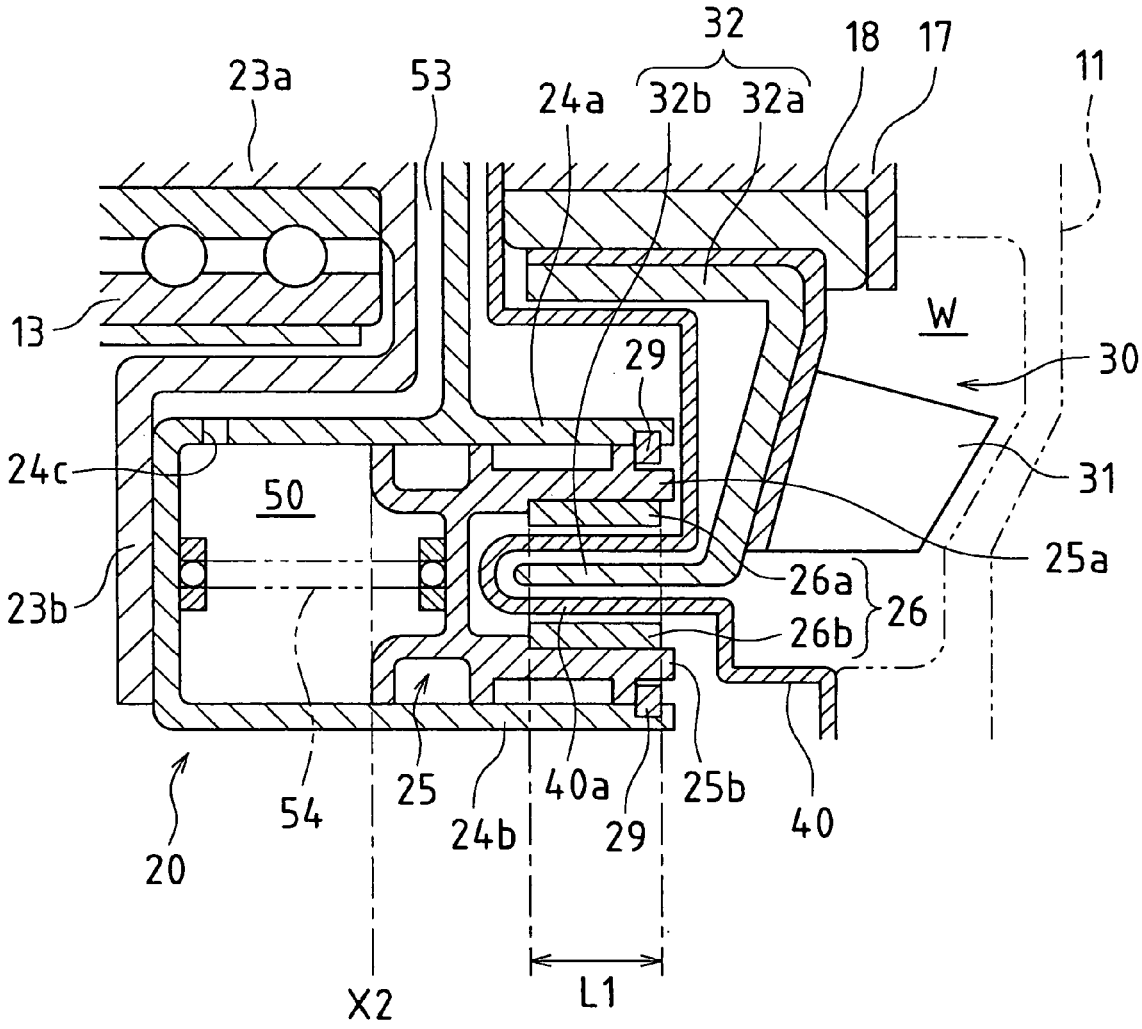
FIG. 2 is a view showing components related to transmission of rotation from a drive-end rotation member to a driven-end rotation member of the water pump of FIG. 1, and showing a condition wherein a vacuum is not introduced into a vacuum chamber.
Figure 3:
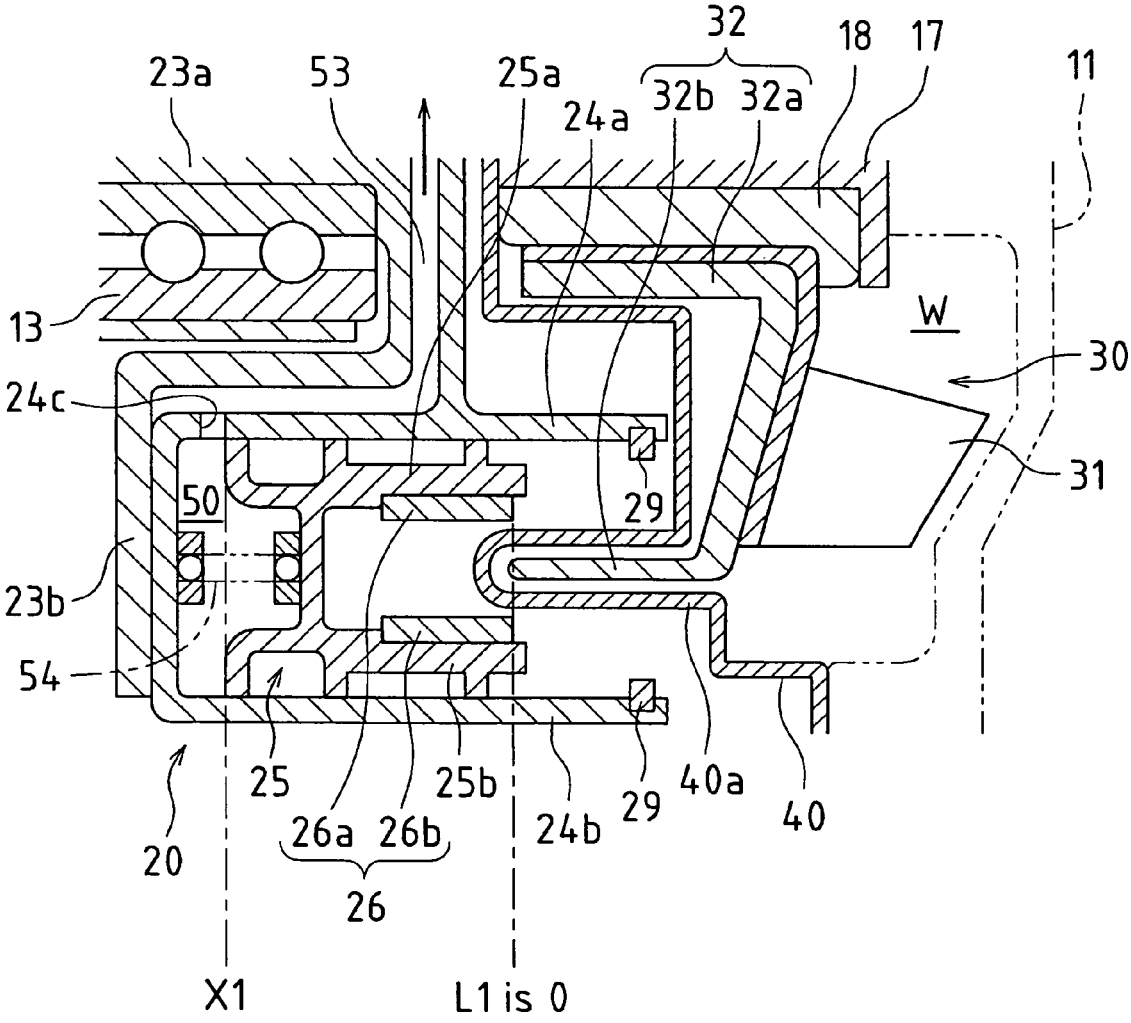
FIG. 3 is a view showing components related to transmission of rotation from the drive-end rotation member to the driven-end rotation member of the water pump of FIG. 1, and showing a condition wherein a vacuum is introduced into the vacuum chamber.

Hereinafter, the present invention is described in terms of an example of application as a water pump used in an automobile engine. FIG. 1 is a cross-section view showing one embodiment of a variable volume type water pump, and FIG. 2 and FIG. 3 show an enlarged view of a section related to transmission of rotation from a drive-end rotation member to a driven-end rotation member of the water pump of FIG. 1. It should be noted that a condition of the water pump wherein a vacuum is not introduced into a vacuum chamber is shown in FIG. 2, and a condition of the water pump wherein a vacuum is introduced into a vacuum chamber is shown in FIG. 3.

As shown in FIG. 1 to FIG. 3, a water pump 10 includes a drive-end rotation member 20 having a water pump pulley 21, a driven-end rotation member 30 having a pump impeller 31, and a dividing wall 40 partitioning an interval between the drive-end rotation member 20 and the driven-end rotation member 30. Furthermore, as explained hereinafter, transmission of rotation from the drive-end rotation member 20 to the driven-end rotation member 30 is carried out in a non-contact condition.

The drive-end rotation member 20 and the driven-end rotation member 30 are provided on a housing 11 of an engine so as to be capable of rotating freely. The drive-end rotation member 20 includes the water pump pulley 21, a mounting plate 22, a drive shaft member 23, a bracket guide member 24, a magnet bracket 25, and a magnet coupling 26, and is configured such that these rotate as one about an axis A1. The drive-end rotation member 20 has a shape with substantial rotation symmetry about the axis A1.

Meanwhile, the driven-end rotation member 30 includes the pump impeller 31 and an induction ring 32 having an induction body, and is configured such that these rotate as one about an axis B1. The driven-end rotation member 30 has a shape with substantial rotation symmetry about the axis B1. It should be noted that the axis A1 and the axis B1 are provided coaxially.

Next, the drive-end rotation member 20, the driven-end rotation member 30, and the dividing wall 40 of the water pump 10 are explained in detail.

First of all, the drive-end rotation member 20 is explained. The drive shaft member 23 of the drive-end rotation member 20 is supported via a bearing 13 so as to be capable of rotation by a boss section 12*a* of a support case 12 secured to the housing 11. The drive shaft member 23 includes a cylindrical shaft section 23*a* extending along an axial direction (rotation axis direction) and a flange section 23*b* provided at an outer side in a radial direction from this shaft section 23*a*. An interior space of the shaft section 23*a* constitutes a vacuum introduction channel 52 for introducing a vacuum into a vacuum chamber 50, explained hereinafter.

The mounting plate 22 and the bracket guide member 24 are mounted as one to the drive shaft member 23. The mounting plate 22 is secured to an axial-direction end section (a left end section of FIG. 1) of the shaft section 23*a*. The water pump pulley 21 is secured to the mounting plate 22 using bolts 28. The water pump pulley 21 is connected via, for example, a V-belt, etc. to a pulley of a crankshaft of the engine.

A vacuum introduction tube 51 is provided at a central axial side of the mounting plate 22. An air seal 14 and a bearing 15 are interposed between a section at a central axial side of the mounting plate 22 and the vacuum introduction tube 51. An end side of the vacuum introduction tube 51 communicates with a vacuum supply channel extending from a vacuum generation source. Another end of the vacuum introduction tube 51 communicates with the above-described vacuum introduction channel 52.

The bracket guide member 24 guides a motion of the magnet bracket 25 in the axial direction and includes an inner guide member 24*a* and an outer guide member 24*b* as a pair. The inner guide member 24*a* and the outer guide member 24*b* are provided so as to be opposed with a prescribed interval therebetween. Furthermore, a space enclosed by the two guide members 24*a*, 24*b* and the magnet bracket 25 constitutes the vacuum chamber 50. That is to say, the two guide members 24*a*, 24*b* of the bracket guide member 24 and the magnet bracket 25 form wall members of the vacuum chamber 50.

The vacuum chamber 50 is a sealed space formed with a substantially toric shape inside the drive-end rotation member 20 and extending in the axial direction and is provided at one side (a Y1 direction side of FIG. 1) of the magnet bracket 25 in the axial direction. The vacuum chamber 50 communicates with the exterior thereof (in this case, a vacuum introduction channel 53) via only a vacuum introduction hole 24*c* provided in the bracket guide member 24. The vacuum introduction hole 24*c* is formed at a plurality of locations in a circumferential direction of the bracket guide member 24. The vacuum introduction channel 53 is a space formed by the flange section 23*b* of the drive shaft member 23 and the inner guide member 24*a* of the bracket guide member 24, and the vacuum chamber 50 communicates with the vacuum introduction channel 52 via this vacuum introduction channel 53.

The magnet bracket 25 constitutes a support member supporting the magnet coupling 26, and in addition, is a member capable of moving in the axial direction in accordance with a vacuum introduced into the vacuum chamber 50. The magnet bracket 25 forms a section of a wall member of the vacuum chamber 50. The magnet bracket 25 is provided with an inner cylindrical section 25*a* and an outer cylindrical section 25*b* as a pair disposed in parallel at an inside and an outside in a radial direction and with a prescribed interval therebetween. The magnet bracket 25 is housed within the two guide members 24*a*, 24*b* of the bracket guide member 24 in a condition so as to be capable of sliding in the axial direction. Furthermore, the magnet bracket 25 is provided so as to be capable of moving in the axial direction along the two guide members 24*a*, 24*b* in accordance with the vacuum introduced into the vacuum chamber 50 and of changing an axial direction position thereof. In this example, the axial direction position of the magnet bracket 25 (the axial direction position of an end section of the magnet bracket 25 at the Y1 direction side thereof) is capable of changing continuously between X1 (a condition shown in FIG. 3) and X2 (a condition shown in FIG. 2). Furthermore, a distance between the X1 and X2 axial direction positions of the magnet bracket 25 is equivalent to a maximum value of an overlap amount L1 described hereinafter.

A plurality of (in this example, 3) protrusions 25*c* extending towards the inner guide member 24*a* of the bracket guide member 24 and making contact with an outer peripheral surface of this inner guide member 24*a* are formed on an inner peripheral side of the inner cylindrical section 25*a*. Furthermore, a plurality of (in this example, 3) protrusions 25*d* extending towards the outer guide member 24*b* of the bracket guide member 24 and making contact with an inner peripheral surface of this outer guide member 24*b* are formed on an outer peripheral side of the outer cylindrical section 25*b*. Using these protrusions 25*c*, 25*d*, the vacuum chamber 50 is maintained in a state of substantial sealing.

A spring 54 is provided inside the vacuum chamber 50. The magnet bracket 25 is biased towards another side (a Y2 direction side of FIG. 1) in the axial direction by an elastic force of the spring 54. Furthermore, a stopper 29 is provided on the bracket guide member 24 in order to regulate the motion of the magnet bracket 25 towards the Y2 direction side.

Vacuum is introduced into the vacuum chamber 50 from a vacuum generation source via the vacuum introduction tube 51, the vacuum introduction channels 52, 53, and the vacuum introduction hole 24*c*. For example, an intake vacuum (suction-pipe vacuum) of the engine can be used as a vacuum generation source. The intake vacuum of the engine is, for example, introduced from suction piping, etc. of the engine via a pressure control valve, etc. into the vacuum chamber 50. Furthermore, the vacuum introduced to the vacuum chamber 50 is controlled by performing opening and closing control of the pressure control valve in accordance with control signals from a control device based on an engine operation condition. By using the engine's intake vacuum, in a situation wherein, for example, cooling water is not circulated so much in order to promote warming of the engine when cold and powerful acceleration is required, control is performed to rotate the pump impeller 31 and overheating thus can be prevented. It should be noted that a configuration using a vacuum generation source other than the intake vacuum of the engine in order to introduce vacuum into the vacuum chamber 50 can be used. For example, a vacuum from a vacuum pump can be used.

The magnet coupling 26 is formed by a pair of toric permanent magnets 26*a*, 26*b* of equivalent width in the axial direction (longitudinal direction). The permanent magnets 26*a*, 26*b* of the magnet coupling 26 are provided at an inside and an outside in a radial direction so as to be opposed with a prescribed interval therebetween. The polarities of opposing sections of the small-diameter permanent magnet 26*a* disposed at an inner side and the large-diameter permanent magnet 26*b* disposed at an outer side are mutually different. Furthermore, the inner-side permanent magnet 26*a* is secured to an outer peripheral surface of the inner cylindrical section 25*a* of the magnet bracket 25. The outer-side permanent magnet 26*b* is secured to an inner peripheral surface of the outer cylindrical section 25*b* of the magnet bracket 25.

Hereinafter, the driven-end rotation member 30 is described. The driven-end rotation member 30 is housed within a cooling water channel W wherethrough cooling water flows. The pump impeller 31 of this driven-end rotation member 30 is supported via an underwater bearing 18 by a shaft member 17 secured to the housing 11 so as to be capable of rotating. Cooling water in the cooling water channel W is discharged to an exterior section pursuant to rotation of this pump impeller 31.

The induction ring 32 for rotating the pump impeller 31 is secured to the pump impeller 31. The induction ring 32 includes a mounting section 32*a* for mounting on the pump impeller 31 and a toric induction section 32*b* extending along an axial direction from an outer end section of this mounting section 32*a* towards a Y1-direction side. This induction section 32*b* is provided as an induction current generating section (induction body) for generating torque transmitted to the driven-end rotation member 30 pursuant to rotation of the drive-end rotation member 20. Of this induction ring 32, at least a portion containing the induction section 32*b* is formed of aluminum. It should be noted that the portion of the induction ring 32 containing the induction section 32*b* can be formed of a metal other than aluminum.

The induction section 32*b* is provided parallel to the permanent magnets 26*a*, 26*b* of the magnet coupling 26 of the drive-end rotation member 20. Furthermore, the induction section 32*b* is disposed in a substantially central position of the permanent magnets 26*a*, 26*b* of the magnet coupling 26 in a radial direction. In addition, the induction section 32*b* is disposed at a position such that, except when the axial direction position of the magnet bracket 25 is X1, the positions in the axial direction of the induction section 32*b* and of the permanent magnets 26*a*, 26*b* of the magnet coupling 26 mutually overlie (overlap).

An interval between the induction section 32*b* and the permanent magnets 26*a*, 26*b* of the magnet coupling 26 is partitioned by a curved section 40*a* of the dividing wall 40 having a U-shaped cross section. Accordingly, the curved section 40*a* of the dividing wall 40 is disposed so as to form a prescribed interval at a pair of inner and outer sides of the induction section 32*b* in the radial direction, and furthermore, the permanent magnets 26*a*, 26*b* of the magnet coupling 26 are disposed so as to form a prescribed interval at a pair of inner and outer sides of the curved section 40*a* of the dividing wall 40 in a radial direction.

In addition, the dividing wall 40 is provided in a section between the drive-end rotation member 20 and the driven-end rotation member 30. The dividing wall 40 is secured to the housing 11. The dividing wall 40 has a shape following a shape of the section between the drive-end rotation member 20 and the driven-end rotation member 30 and includes the above-described curved section 40*a*. The interval between the drive-end rotation member 20 and the driven-end rotation member 30 is separated by this dividing wall 40 such that penetration of cooling water into the side of the drive-end rotation member 20 is prevented. Therefore, transmission of rotation from the drive-end rotation member 20 to the driven-end rotation member 30 is carried out in a non-contact condition. Hereinafter, this transmission of rotation from the drive-end rotation member 20 to the driven-end rotation member 30 is explained.

The drive-end rotation member 20, configured as explained above, is driven to rotate due to the transmission of rotation of the crankshaft to the water pump pulley 21 upon engine drive. Here, a magnetic field is generated between the permanent magnets 26*a*, 26*b* of the magnet coupling 26 of the drive-end rotation member 20. Furthermore, in this case, substantially-linear lines of magnetic force extending from one of the permanent magnets 26*a*, 26*b* of the magnet coupling 26 to the other thereof are generated. That is to say, the lines of magnetic force are generated with almost no widening beyond the permanent magnets 26*a*, 26*b* to an outer side in the axial direction. For this reason, almost no leakage of flux beyond the permanent magnets 26*a*, 26*b* to an outer side in the axial direction occurs.

Accordingly, when the axial direction position of the magnet bracket 25 is not X1, the magnetic field from the permanent magnets 26*a*, 26*b* of the magnet coupling 26 acts upon the induction section 32*b* of the induction ring 32 of the driven-end rotation member 30 enclosed between the permanent magnets 26*a*, 26*b* of the magnet coupling 26.

In this condition, when the drive-end rotation member 20 rotates, the magnetic field acting upon the induction section 32*b* of the induction ring 32 changes. As a result of this, an induction current in a direction obstructing the magnetic field change is generated within the induction section 32*b* of the induction ring 32. A torque is generated in the induction section 32*b* of the induction ring 32 pursuant to this induction-current generation. As a result of this, rotation of the induction ring 32 and the pump impeller 31, that is to say, of the driven-end rotation member 30, occurs and cooling water in the cooling water channel W is discharged to the exterior.

Meanwhile, when the axial direction position of the magnet bracket 25 is X1, the magnetic field of the magnet coupling 26 barely acts on the induction section 32*b* of the induction ring 32, and therefore, generation of the induction current in the induction section 32*b* becomes almost non-existent and almost no torque is generated in the induction section 32*b*. Accordingly, the configuration is such that the driven-end rotation member 30 does not rotate and the water pump 10 does not drive.

In this example, a moving means is provided to move the permanent magnets 26*a*, 26*b* of the magnet coupling 26 in the axial direction with respect to the induction section 32*b* of the induction ring 32 and to change the overlap amount in the axial direction (degree of mutual overlap in the axial direction) L1 of the permanent magnets 26*a*, 26*b* of the magnet coupling 26 and the induction section 32*b* of the induction ring 32. In addition, the configuration is such that the torque transmitted to the driven-end rotation member 30 is changed due to changing of the overlap amount L1 using the moving means. As a result of this, a rotation speed of the driven-end rotation member 30 is changed and a volume of discharge (pump flow volume) of cooling water by the water pump 10 is changed.

Furthermore, in this example, the above-explained moving means includes the vacuum chamber 50 and the magnet bracket 25 acting as a movable member moving in the axial direction in accordance with the vacuum introduced into this vacuum chamber 50. In addition, the magnet bracket 25 moves along the axial direction in accordance with the vacuum introduced into the vacuum chamber 50, and in line with this, the overlap amount L1 is set.

Hereinafter, changing of the overlap amount L1 in the water pump 10 and changing of torque transmitted to the driven-end rotation member 30 in line with this change in the overlap amount L1 are explained.

In a case wherein vacuum is not introduced into the vacuum chamber 50, the magnet bracket 25 is biased towards a Y2 direction side by the elastic force of the spring 54 and moves as far as a position regulated by the stopper 29. Specifically, the axial direction position of an end section of the magnet bracket 25 on the Y1 direction side thereof becomes the X2 position. In this condition, the overlap amount L1 is equivalent to a width of the permanent magnets 26*a*, 26*b* in the axial direction and is maximized. Accordingly, the induction current generated in the induction ring 32 is maximized in this condition, and therefore, the torque transmitted to the driven-end rotation member 30 is maximized. As a result, the pump flow volume of the water pump 10 is maximized.

Next, when vacuum is introduced into the vacuum chamber 50, a suction force acts on the magnet bracket 25 in line with the introduction of that vacuum. As a result of this, the magnet bracket 25 moves along the axial direction, and the overlap amount L1 changes in accordance with the distance of motion in the axial direction by the magnet bracket 25.

In such a case, the larger the vacuum introduced into the vacuum chamber 50, the smaller the overlap amount L1 due to motion of the magnet bracket 25 towards the Y1 direction side against the elastic force of the spring 54. Furthermore, when the overlap amount L1 becomes smaller, the induction current generated in the induction ring 32 becomes smaller and the torque transmitted to the driven-end rotation member 30 becomes smaller. As a result of this, the rotation speed of the driven-end rotation member 30 decreases and the pump flow volume of the water pump 10 decreases. Therefore, for example, at cold times such as when the engine is started, the overlap amount L1 can be made small and the pump flow volume of the water pump 10 can be reduced in order to achieve rapid heating.

Conversely, the smaller the vacuum introduced into the vacuum chamber 50, the larger the overlap amount L1 due to motion of the magnet bracket 25 towards the Y2 direction side. When the overlap amount L1 becomes larger, the induction current generated in the induction ring 32 becomes larger and the torque transmitted to the driven-end rotation member 30 becomes larger. As a result of this, the rotation speed of the driven-end rotation member 30 increases and the pump flow volume of the water pump 10 increases. Therefore, for example, at hot times such as after warming-up of the engine, the overlap amount L1 can be made large and the pump flow volume of the water pump 10 can be increased in order to increase the cooling efficiency.

Furthermore, when the end section of the magnet bracket 25 in the Y1 direction side thereof moves due to the vacuum as far as the position whereat the vacuum introduction hole 24*c* is provided (axial direction position is X1 position), the overlap amount L1 becomes "0". In this condition, the magnetic field of the magnet coupling 26 acting on the induction section 32*b* of the induction ring 32 becomes almost non-existent, and therefore, the induction current generated in the induction ring 32 becomes substantially "0". As a result of this, the torque transmitted to the driven-end rotation member 30 becomes substantially 0 and rotation of the driven-end rotation member 30 stops. Accordingly, driving of the water pump 10 stops and the pump flow volume thereof becomes "0".

As explained above, when the overlap amount L1 is changed in the water pump 10, the induction current generated in the induction section 32*b* of the induction ring 32 changes, and the torque transmitted to the driven-end rotation member 30 changes. As a result of this, the rotation speed of the driven-end rotation member 30 is changed and the pump flow volume of the water pump 10 is changed. That is to say, in this example, the water pump 10 is configured such that the pump flow volume can be continuously changed in accordance with the overlap amount L1 set depending on the vacuum introduced into the vacuum chamber 50. Furthermore, in this example, the water pump 10 is configured such that the magnetic field acting on the induction ring 32 of the driven-end rotation member 30 and torque transmitted to the driven-end rotation member 30 are generated by the magnet coupling 26 of the drive-end rotation member 20.

As explained above, the permanent magnets 26*a*, 26*b* of the magnet coupling 26 are disposed so as to be mutually opposed with different polarities, and therefore, substantially-linear lines of magnetic force extending from one of the permanent magnets 26*a*, 26*b* of the magnet coupling 26 to the other thereof are generated and almost no leakage of flux beyond the permanent magnets 26*a*, 26*b* to an outer side in the axial direction occurs. As a result of this, when the overlap amount L1 is set larger than 0 and the water pump 10 is driven, torque can be efficiently transmitted to the driven-end rotation member 30 and drive loss due to flux leakage can be reduced.

Figure 4:
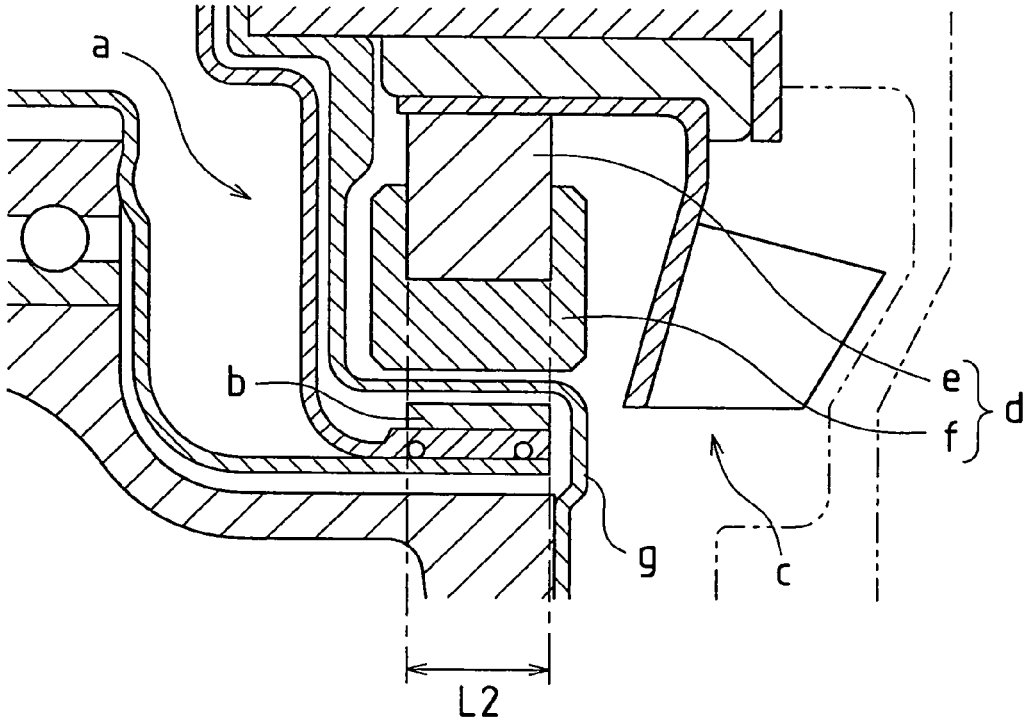
FIG. 4 is a view corresponding to FIG. 2 showing the components related to the transmission of rotation from a drive-end rotation member to a driven-end rotation member of a conventional water pump.

Meanwhile, if the overlap amount L1 is set to "0", the torque transmitted to the driven-end rotation member 30 becomes substantially "0", and driving of the water pump 10 can be stopped. Here, for example, in a situation wherein flux leakage to the surroundings occurs such as in a case shown in FIG. 4, etc., even if the overlap amount L1 is set to "0", an induction current is generated in the induction ring 32 of the driven-end rotation member 30 due to that flux leakage, and therefore, a torque transmitted to the driven-end rotation member 30 is generated and the water pump 10 is driven. In order, therefore, to stop driving of the water pump 10, simply setting the overlap amount L1 to "0" is not sufficient, and it is necessary to offset the permanent magnets 26*a*, 26*b* of the magnet coupling 26 and the induction section 32*b* of the induction ring 32 by a prescribed distance in the axial direction.

In contrast, in this example, that type of flux leakage barely occurs, and therefore, when the overlap amount L1 is 0, driving of the water pump 10 can be stopped. Accordingly, it becomes no longer necessary to secure that type of offset in the axial direction. As a result of this, the water pump 10 does not increase in size in the axial direction, and a compact configuration thereof can be achieved. In addition, deterioration of mounting characteristics at locations of installation of the water pump 10 (for example, a front side of an engine) can be avoided.

Although an embodiment of the water pump according to the present invention was explained above, the explained embodiment may be subjected to a wide range of modifications.

If the configuration is such that rotation can be transmitted from the drive-end rotation member 20 to the driven-end rotation member 30 in a non-contact condition, the component parts in the form of the drive-end rotation member 20, the driven-end rotation member 30, and the dividing wall 40 and the shapes and disposition locations, etc. thereof are not limited to the above-explained case alone and a wide range of modifications are possible. Here, the narrower the interval between the permanent magnets 26*a*, 26*b* of the magnet coupling 26 and the induction section 32*b* of the induction ring 32, the more efficient the transmission of torque to the driven-end rotation member 30 becomes.

If the configuration is such that the overlap amount L1 can be changed, the component parts in the form of the magnet bracket 25 of the drive-end rotation member 20, the vacuum chamber 50, and the vacuum introduction channels 52, 53, etc. and the shapes and disposition locations, etc. thereof are not limited only to the above-explained case alone and a wide range of modifications are possible. Here, the configuration can be such that the larger the vacuum introduced into the vacuum chamber 50, the larger the overlap amount L1. Furthermore, the configuration can be such that other than vacuum is used to change the overlap amount. For example, positive pressure can be used in place of vacuum. In addition, a hydraulic actuator or electrical actuator, etc. can be used.

Although the configuration is such that the magnet coupling 26 is provided on the drive-end rotation member 20 and the induction ring 32 is provided on the driven-end rotation member 30 in the above-explained example, in contrast to this case, the configuration can be such that an induction ring is provided on a drive-end rotation member and a magnet coupling is provided on a driven-end rotation member. Furthermore, although the configuration is such that the magnet coupling 26 moves in the axial direction in the above-explained example, in contrast to this case, the configuration can be such that the induction ring 32 is moved in the axial direction.

It should be noted that without departure from the intention and principal characteristics thereof, the present invention can have many other embodiments. Accordingly, the above-described embodiment is no more than a simple example and should not be interpreted in a limited manner. The scope of the present invention is set forth by the scope of the claims, and the disclosure is in no way binding. Furthermore, all modifications and changes within a scope equivalent to that of the claims are within the scope of the present invention.

This application claims priority from Japanese Patent Application No. 2006-351938, filed in Japan on Dec. 27, 2006, which is incorporated herein by reference. Furthermore, all of the content of the cited documentation is specifically incorporated herein by reference.

The invention claimed is:

1. A water pump, configured such that rotation is transmitted in a non-contact condition from a drive-end rotation member whereto rotation is transmitted from an engine to a driven-end rotation member having a pump impeller, comprising:

a pair of magnets provided on one of the drive-end rotation member and the driven-end rotation member so as to be mutually opposed with different polarities, a first magnet of the pair of magnets is disposed at a first radius from a central axis of the water pump and a second magnet of the pair of magnets is disposed at a second radius from the central axis of the water pump, the second radius being larger than the first radius;

an induction body provided on the other of the drive-end rotation member and the driven-end rotation member so as to form a prescribed interval in between the pair of magnets; and a moving means moving at least one of the pair of magnets and the induction body with respect to the other of the pair of magnets and the induction body in an axial direction along a rotational axis and changing a degree of mutual overlap of the pair of magnets and the induction body in the axial direction.

2. The water pump according to claim 1, wherein:

the moving means comprises a vacuum chamber provided on one of the drive-end rotation member and the driven-end rotation member and a movable member moving in the axial direction in accordance with a vacuum introduced into the vacuum chamber; and the pair of magnets or the induction body is provided on the movable member.

3. The water pump according to claim 2, wherein:

the vacuum chamber comprises the movable member and a guide member guiding a motion of the movable member towards the axial direction.

4. The water pump according to claim 2, wherein:

an intake vacuum of the engine is introduced into the vacuum chamber.

5. The water pump according to claim 3, wherein:

an intake vacuum of the engine is introduced into the vacuum chamber.

* * * * *